United States Patent [19]

Zodrow

[11] 4,127,435

[45] Nov. 28, 1978

[54] LABELING STATION OF A MACHINE FOR LABELING OBJECTS, ESPECIALLY BOTTLES

[75] Inventor: Rudolf Zodrow, Dusseldorf, Germany

[73] Assignee: Jagenberg-Werke AG, Dusseldorf, Germany

[21] Appl. No.: 790,358

[22] Filed: Apr. 25, 1977

[30] Foreign Application Priority Data

May 3, 1976 [DE] Fed. Rep. of Germany ..... 2619068

[51] Int. Cl.[2] ..... B65C 9/16; B65H 3/20

[52] U.S. Cl. ..... 156/568; 118/231; 118/236; 156/571; 156/DIG. 29; 156/DIG. 32; 271/33

[58] Field of Search ..... 156/567, 568, 571, 578, 156/DIG. 29, DIG. 30, DIG. 32; 271/33, 95, 115, 270, 264; 118/220, 231, 236, 240

[56] References Cited

U.S. PATENT DOCUMENTS 3,546,047 12/1970 Dullinger ..... 156/571 X
3,735,731 5/1973 Tavernier ..... 156/568 X
3,928,120 12/1975 Zodrow ..... 156/568

FOREIGN PATENT DOCUMENTS 2,325,244 12/1974 Fed. Rep. of Germany ..... 156/571

*Primary Examiner*—Michael G. Wityshyn
*Attorney, Agent, or Firm*—Sprung, Felfe, Horn, Lynch & Kramer

[57] ABSTRACT

A labeling station of a labeling machine for bottles or the like having a gripping cylinder rotatable in one direction. The station includes a rotatable carrier and at least one glue segment mounted on the carrier for oscillatory rotational movement about an axis of rotation disposed between the center of curvature of its cylindrically curved pickup surface and the pick up surface, to dispose the center of the pickup surface tangential to the gripping cylinder at the center of the oscillatory movement. The rotational movement of the gluing segment is accelerated and retarded to effect rolling of the pickup surface on the gripping cylinder, by rotating the carrier and gripping cylinder in the same direction and rotating the gluing segment in the opposite direction during the rolling contact.

3 Claims, 4 Drawing Figures

LABELING STATION OF A MACHINE FOR LABELING OBJECTS, ESPECIALLY BOTTLES

BACKGROUND

The invention relates to a labeling station in a machine for labeling objects, especially bottles, having at least one gluing segment which is mounted on a driven, revolving carrier, whose axis of rotation is situated between the center of curvature of its especially cylindrically curved pickup surface and the said pickup surface, and whose rotational speed is accelerated and retarded for the purpose of rolling its pickup surface on the surface of a rotating gripper cylinder.

In a known labeling station of this kind, the carrier and gripper cylinder rotate in opposite directions, while their circumferential speeds are approximately equal. To enable a rolling of the gluing segment on the gripper of these geometrical conditions and these conditions of movement, the radius of curvature of the pickup surface of each glue segment is equal to the radius of the circle defined by the individual stations of the labeling machine, such as the label stack, the gripper cylinder, and the gluing roller. In order to make possible a rolling of the gluing segment on the gripper cylinder under these geometrical conditions and these conditions of movement, the gluing segment which is controlledly swung back and forth is halted in the middle position upon passing the gripper cylinder, in which its pickup surface coincides with the circumference of the glue segment carrier. A disadvantage of this labeling station is that the division of the gluing segment carrier must coincide with that of the labeling cylinder (German Offenlegungsschrift No. 1,486,135).

According to my copending U.S. application Ser. No. 754,869 now abandoned which is a continuation of U.S. application Ser. No. 597,276 now abandoned, a more optimum division of the glue segment carrier can be achieved if the gluing segment carrier and the gripper cylinder have the same sense of rotation and the glue segment or segments rotate in the opposite sense. In this system it is not necessary that the division of the gluing segment carrier be identical with that of the gripper cylinder. In the invention, it is possible with a single gluing segment to transfer the labels to a labeling cylinder of fourfold division. The central idea of the above copending application is based on the knowledge that, through the rotation of the gluing segments in the sense opposite that of the glue segment carrier, the rotatory movement of the gluing segment carrier can be overcompensated for the purpose of arriving at a complete rolling action on the gripping cylinder.

Since the gluing segment or segments rotate about their axes, the rotatory movement only being accelerated and retarded by a cam-controlled drive, it is possible with the labeling station of the principal patent to achieve very high outputs.

THE INVENTION

The invention is, however, addressed to the problem of creating a labeling station which, while having the same output capacity as the known labeling station with oscillating gluing segments, will have fewer gluing segments, and in which the fitting of the carrier with gluing segments will be variable.

This problem is solved by the invention in that, while the sense of rotation of the glue segment carrier and of the gripper cylinder is the same, the gluing segment or segments perform, upon rolling against the gripper cylinder, a rotatory movement whose sense is the opposite of that of the gluing segment carrier and of the gripper cylinder.

This additional improvement of the invention sets out from the idea that, in the rolling process, only the rotational sense relationships of the gripper cylinder, gluing segment carrier and gluing segment or segments are important, while the gluing segments can perform any desired movements before and after the rolling movement. It is only important that the gluing segment or segments be brought into their starting position at the beginning of the new rolling action.

While this is achieved in the principal patent by the completion of the rotatory movement, it is achieved in the present invention in that the gluing segment or segments which are swung in the one sense during the rolling process are swung back again before the next rolling process. On account of the reversal of the direction of rotation of the glue segment, the labeling station of the invention does not have the same high output capacity as that of the principal patent. The advantage of the present labeling station, however, is that a substantially more simply designed, cam-controlled drive can be used for driving the gluing segments. If high outputs are not especially important, but it is desired to get by with a low number of gluing segments, preference will be given to the system of the invention using the oscillated gluing segments.

BRIEF DESCRIPTION OF THE DRAWINGS

The invention will be further explained below with reference to the appended drawing representing an embodiment thereof, wherein.

Figure 1:
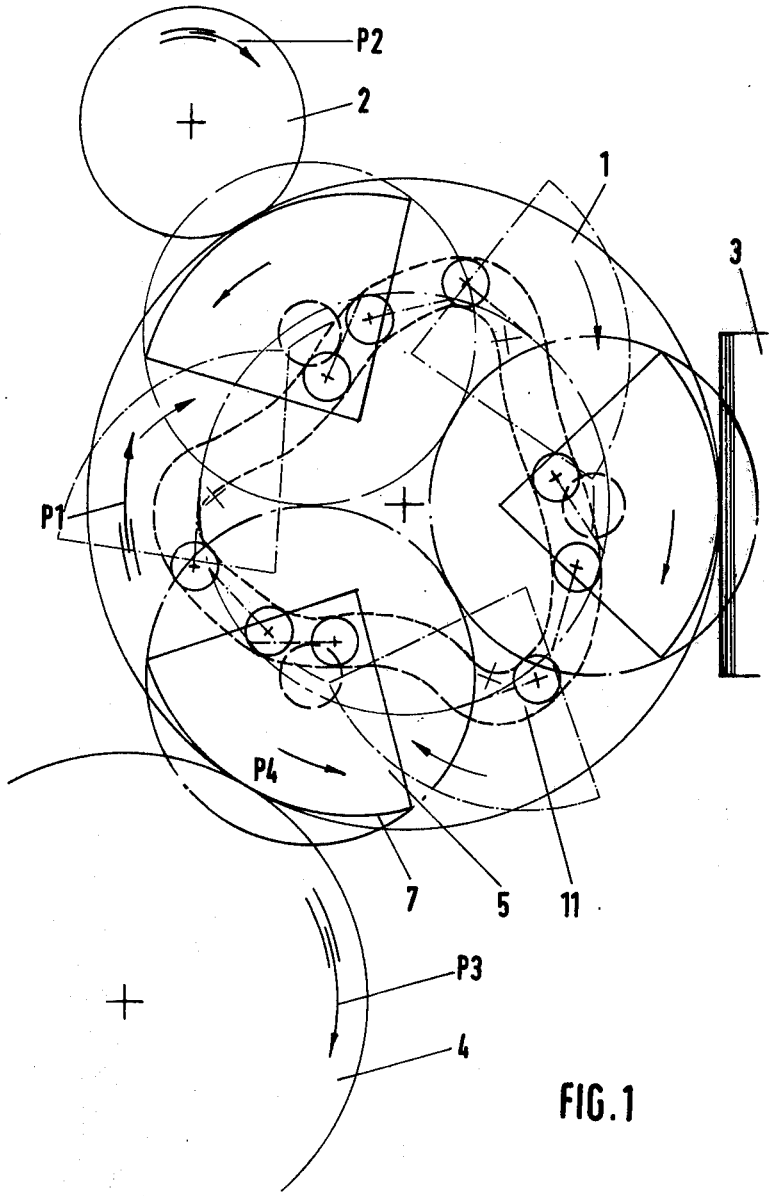
FIG. 1 is a diagrammatic plan view of a labeling station having three gluing segments.

The labeling station consists of a gluing segment carrier 1 rotating in the direction of the arrow P1, and stations disposed successively along its periphery, namely a glue roller 2 rotating in the direction of the arrow P2, a stationary label box 3 and a gripper cylinder 4 rotating in the direction of the arrow P3. The gluing segment carrier is coupled with the gripper cylinder 4 through a gear drive. If the gripper cylinder 4 is quadripartite and the gluing segment carrier 1 is provided with three gluing segments 5 (FIG. 1), the gearing ratio will amount to 3:4, while in the case of a quadripartite gripper cylinder 4 and a gluing segment carrier 1 provided with two gluing segments 5 it will be 1:2. The gluing segments are uniformly distributed about the gluing segment carrier and at a distance from the axis of rotation thereof. Each gluing segment 5 has a cylindrically curved pickup surface 7 whose radius of curvature is smaller than the distance between the axis of the gluing segment carrier 1 and the periphery of the gripper cylinder 4. The gluing segment 5 is pivotingly mounted on the gluing segment carrier 1 at a point between its pickup surface 7 and the center of its curvature, in a symmetrical relationship to its pickup surface 7.

A cam operated toothed segment 8, whose teeth mesh with the teeth of a pinion 10 mounted on a shaft 9 of the gluing segment 5 serves as the driving means. When the gluing segment carrier 1 rotates, the toothed segment 8 is swung back and forth by a cam follower 12 engaged by a stationary cam groove 11. Since such a drive is provided for each gluing segment 5, the gluing segment is swung back and forth in the direction of the arrow P4 such that it rolls its pickup surface not only against the glue roller 2 but also against the label stack 3 and against the gripper cylinder 4. For this purpose it is swung out of the circle defined by the individual stations 2, 3 and 4.

Figure 2:
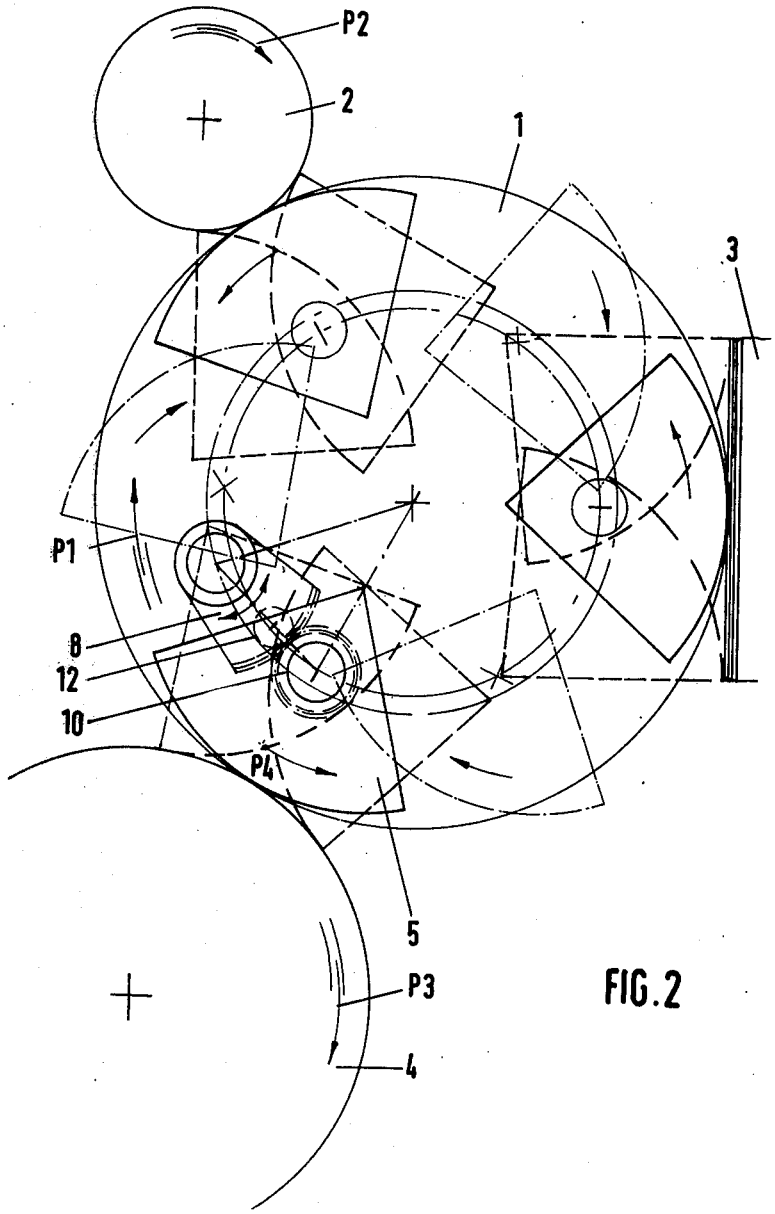
FIG. 2 represents the labeling station of FIG. 1 in the same manner, additionally showing a drive for one gluing segment.

As seen in FIG. 2, the gluing segment, before passing the individual stations 2, 3 and 4, is swung so that its edge that is trailing with respect to the arrow P1 will move outside of the circle defined by the individual stations 2, 3 and 4, and by the swing against the sense of rotation indicated by the arrow P1, a rotatory movement will be superimposed on the rotatory movement of the gluing segment carrier 1 in the direction of the arrow P1; this superimposed rotatory movement will result in an overcompensation and thus allow the pickup surface of the gluing segment 5 to roll against the individual stations 2, 3 and 4. After the end of the rolling action at the one station the swinging movement is reversed, so that the gluing segment is carried to the next station in the starting position for the next rolling action.

Figure 3:
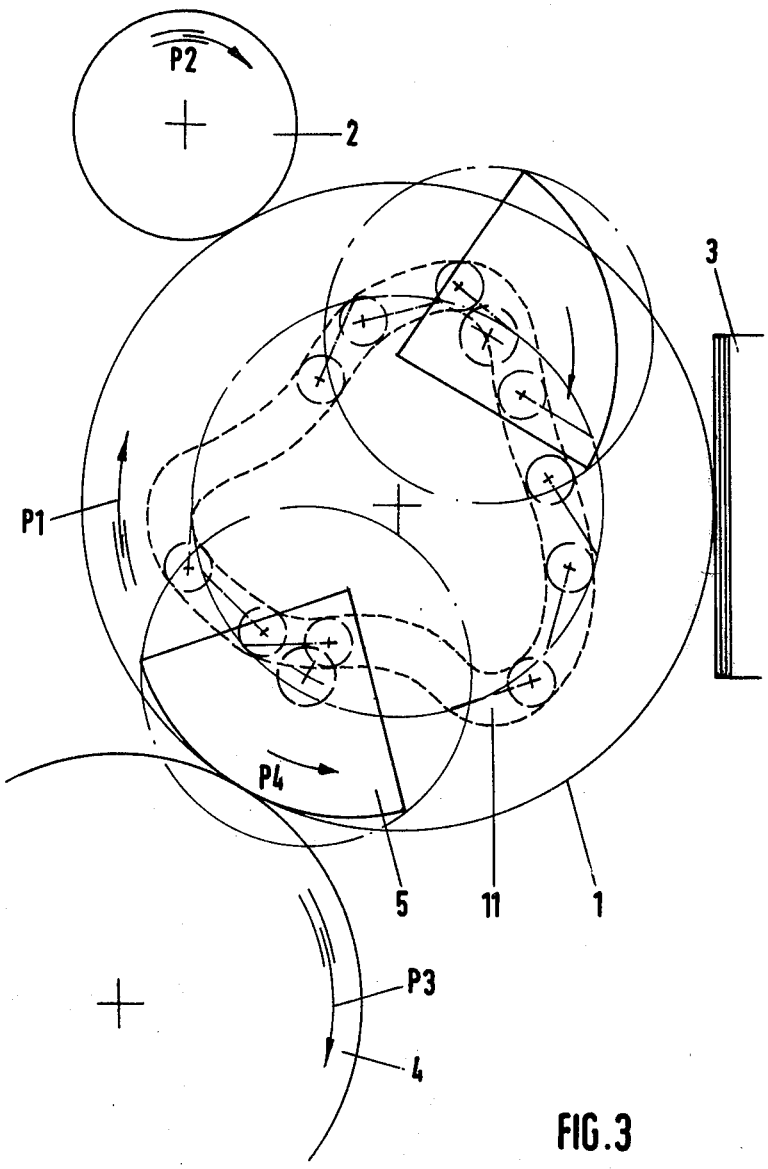
FIG. 3 is a diagrammatic top plan view of a labeling station having two gluing segments.
Figure 4:
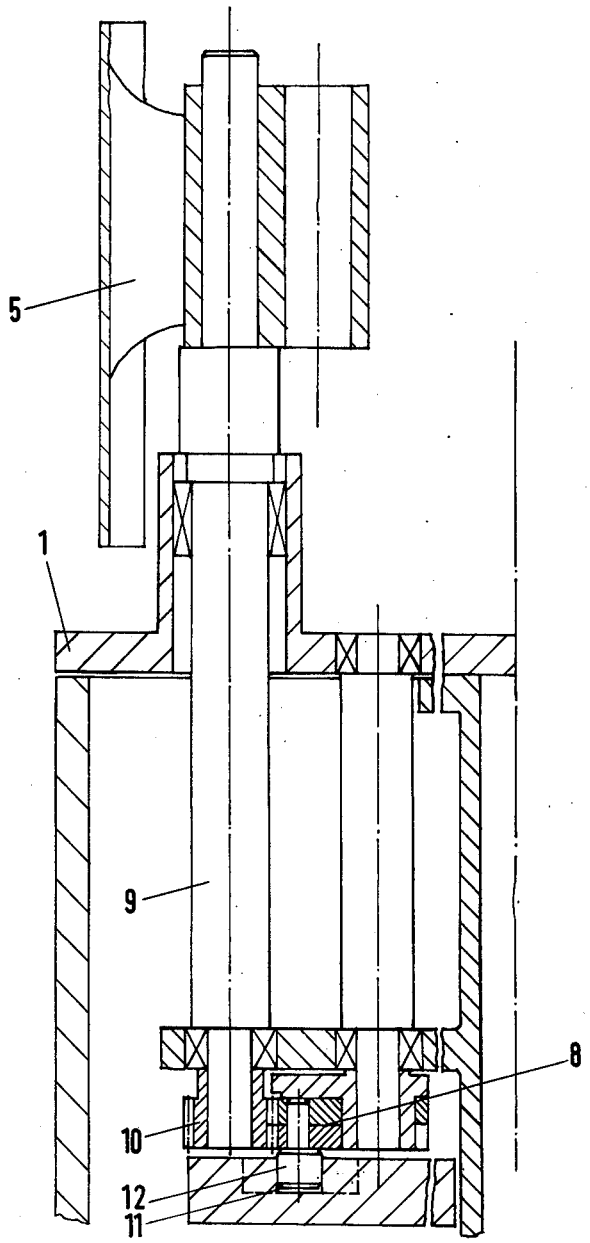
FIG. 4 is an axial cross-sectional view of a gluing segment with its drive.

Each gluing segment 5 touches, with its trailing edge in the direction of rotation of the arrow P1, first the respective station 2, 3, 4 and, in order to conduct the rolling process it is moved past the respective station 2, 3, 4 long enough in a direction counter to arrow P1 and leaves the station 2, 3 or 4. Then the gluing segment 5, on the way to the next station, is accelerated as a result of moving in the direction of arrow P1 in such a manner that the trailing edge of the gluing segment again swings outside the circle corresponding to carrier 1, whereby the gluing segment 5 is moved into the starting position for the next station. This movement is clearly illustrated in FIGS. 1 to 3 with the segments shown in dash-and-dot lines between the individual stations. The movement arrows show the direction of rotation for each segment illustration. In the cases in which arrows P1 and P4 point in the same direction, an acceleration is obtained, and where they point in opposite directions, the segment experiences a retardation of rotational speed.

It will be appreciated that the instant specification and example are set forth by way of illustration and not limitation, and that various modifications and changes may be made without departing from the spirit and scope of the present invention.

What is claimed is:

1. In a labeling station of a labeling machine for objects, such as bottles or the like of the type having a gripping cylinder rotatable in one direction, wherein the improvement comprises: a rotatable carrier, at least one gluing segment having a cylindrically curved pickup surface and mounted on the carrier for oscillatory movement about an axis of rotation disposed between the center of curvature of the cylindrically curved pickup surface and the pickup surface, to dispose the center of the pickup surface tangential to the gripping cylinder at the center of the oscillatory movement and means for accelerating and retarding the rotational speed of the gluing segment to effect the rolling of its pickup surface on the surface of the rotating gripping cylinder including means for rotating the gluing segment carrier in the same direction as that of the gripper cylinder and means driving each gluing segment for rolling on the gripper cylinder to perform a rotatory movement whose direction of rotation is opposite that of the gluing segment carrier and of the gripper cylinder wherein each gluing segment swings in the one direction of rotation upon the rolling action and swings same back again before the next rolling action.

2. The labeling station according to claim 1, wherein the driving means effect contact of the gripping cylinder with alternately, the leading and trailing edges of each gluing segment.

3. The labeling station of claim 1, wherein the driving means comprises a stationary cam groove and, for each gluing segment, a cam follower engaged in the cam groove and rotatable with the rotatable carrier to impart oscillatory motion to the gluing segment, said cam follower having a toothed segment to which the oscillatory movement is imparted and a shaft having a pinion engaged with the toothed segment for effecting the oscillatory movement of the gluing segment,

* * * * *